US011939728B2

(12) United States Patent
Candel

(10) Patent No.: US 11,939,728 B2
(45) Date of Patent: Mar. 26, 2024

(54) ANCHORING ASSEMBLY FOR FASTENING A RAILWAY RAIL TO AN UNDERLYING FOUNDATION

(71) Applicant: Pandrol Limited, Addlestone (GB)

(72) Inventor: Bruno M. B. Candel, Lambres lez Douai (FR)

(73) Assignee: Pandrol Limited, Addlestone (GB)

( * ) Notice: Subject to any disclaimer, the term of this patent is extended or adjusted under 35 U.S.C. 154(b) by 817 days.

(21) Appl. No.: 17/042,507

(22) PCT Filed: Feb. 12, 2019

(86) PCT No.: PCT/GB2019/050373
§ 371 (c)(1),
(2) Date: Sep. 28, 2020

(87) PCT Pub. No.: WO2019/186097
PCT Pub. Date: Oct. 3, 2019

(65) Prior Publication Data

US 2021/0025116 A1 Jan. 28, 2021

(30) Foreign Application Priority Data

Mar. 29, 2018 (GB) ..... 1805187

(51) Int. Cl.
*E01B 9/02* (2006.01)
*E01B 9/48* (2006.01)
*E01B 9/68* (2006.01)

(52) U.S. Cl.
CPC ..... *E01B 9/02* (2013.01); *E01B 9/483* (2013.01); *E01B 9/68* (2013.01); *E01B 2201/04* (2013.01); *E01B 2205/00* (2013.01)

(58) Field of Classification Search
CPC ... E01B 9/02; E01B 9/483; E01B 9/68; E01B 2201/04; E01B 2205/00
See application file for complete search history.

(56) References Cited

U.S. PATENT DOCUMENTS 3,784,097 A 1/1974 Landis

FOREIGN PATENT DOCUMENTS

CN 203065902 U 7/2013
CN 107227660 A * 10/2017 ..... E01B 9/46
(Continued)

OTHER PUBLICATIONS

Office Action for corresponding CN application No. 2019800236369 dated Jan. 30, 2022.
(Continued)

*Primary Examiner* — Robert J McCarry, Jr.

(57) ABSTRACT

An anchoring assembly for fastening a railway rail to an underlying foundation, the anchoring assembly including a base plate configured to receive the rail, a fastener configured to fasten the base plate to the underlying foundation, and a rigid sleeve defining a passage through which a stem of the fastener passes. The base plate comprises an opening and the sleeve is configured to extend through the base plate opening, the sleeve extends a distance greater than a thickness of the base plate such that the sleeve extends from a top surface of the base plate and beyond a bottom surface of the base plate when installed, and the sleeve is configured such that a compressive load applied by the fastener when installed is transmitted through the sleeve to the underlying foundation.

18 Claims, 5 Drawing Sheets

(56) References Cited

FOREIGN PATENT DOCUMENTS

| | | | |
|---|---|---|---|
| CN | 107227660 | A | 10/2017 |
| CN | 207244357 | U | 4/2018 |
| EP | 0794289 | A1 | 9/1997 |
| EP | 1041200 | A2 | 10/2000 |
| WO | 2016071379 | A1 | 5/2016 |

OTHER PUBLICATIONS

ISRWO of corresponding PCT/GB2019/050373 dated Apr. 16, 2019.
UK search report of corresponding GB1805187.0 dated Sep. 20, 2018.

* cited by examiner

ANCHORING ASSEMBLY FOR FASTENING A RAILWAY RAIL TO AN UNDERLYING FOUNDATION

FIELD OF THE DISCLOSURE

The present disclosure relates to an anchoring assembly for fastening a railway rail to an underlying foundation and particularly, although not exclusively, relates to an anchoring assembly comprising a fastener that passes through a rigid sleeve, a compressive load being transmitted through the sleeve when fastening a base plate to the underlying foundation.

BACKGROUND

FIG. 1 shows a railway rail fastening assembly 10 to which the present invention may be applied. The rail fastening assembly 10 comprises a base plate 12, which extends beneath a rail 13 and is configured to receive railway rail fastening clips 14 either side of the rail. The railway rail fastening assembly 10 further comprise a pair of fasteners 30, such as studs, bolts or screws. The fasteners fasten the base plate 12 to an underlying foundation 16, such as a railway sleeper or slab. A resilient pad 15 may be provided between the base plate 12 and the underlying foundation 16. The clips 14 retained by the base plate 12 bear on a rail base or foot 17 of the rail 13. The clips 14 secure the railway rail 13 to the underlying foundation 16 by virtue of forces exerted by the clip on the base plate 12 and the rail 13.

During use the baseplate 12 is subjected to a combination of vertical and lateral loads. The vertical load component is directed down through the base plate 12 and resilient pad 15 into the underlying foundation 16. By contrast, the lateral loads are transmitted into the underlying foundation 16 through a combination of: (a) shear forces at the interface between the lowest layer of the railway rail fastening assembly 10 and the upper surface of the underlying foundation 16; and (b) lateral forces applied through the fasteners 30 used to fix down the base plate 12.

It is desirable to be able to adjust the vertical position of the base plate 12 relative to the underlying foundation 16. However, as the base plate 12 is raised, the bending moment acting on the fasteners 30 may increase, which may limit the vertical adjustability.

The fasteners 30 may be cast into the underlying foundation 16. However, such an arrangement makes it difficult to remove or adjust the position of the base plate 12 once the rail 13 is in position, because it is not possible to pass the baseplate over the cast-in fasteners without lifting the rail. Fasteners 30 that are instead threaded into the underlying foundation 16 are preferable in this regard as they can be unthreaded to allow the base plate 12 to be removed or adjusted. However, threads on a shaft of the fastener 30 may compromise the strength of the fastener, particularly in respect of its ability to withstand the lateral forces.

SUMMARY OF THE DISCLOSURE

According to an aspect of the present invention there is provided an anchoring assembly for fastening a railway rail to an underlying foundation; the anchoring assembly comprising: an anchoring device, such as a base plate, configured to receive the rail; a fastener configured to fasten the anchoring device to the underlying foundation; and a rigid sleeve defining a passage through which a stem of the fastener passes, wherein the anchoring device comprises an opening and the sleeve is configured to extend through the anchoring device opening, wherein the sleeve extends a distance greater than a thickness of the anchoring device such that the sleeve extends from a top surface of the anchoring device and beyond a bottom surface of the anchoring device when installed, and wherein the sleeve is configured such that a compressive load applied by the fastener when installed is transmitted through the sleeve to the underlying foundation.

The compressive load applied by the fastener may substantially bypass any intermediate members provided between the base plate and the underlying foundation.

The anchoring assembly may further comprise a resilient pad provided between the base plate and the underlying foundation. The sleeve may pass through an opening in the resilient pad. The compressive load transmitted through the sleeve may substantially bypass the resilient pad. The compressive load transmitted through the sleeve may be greater than a compressive load transmitted through the resilient pad.

The fastener may comprise a head at one end of the stem. The fastener may clamp the sleeve between the underlying foundation and the head of the fastener.

The anchoring assembly may further comprise a spreader plate provided between the fastener head and the sleeve.

The anchoring assembly may further comprise a washer provided between the fastener head and the sleeve. The washer may be provided between the fastener head and the spreader plate.

The sleeve may engage, e.g. contact, the underlying foundation. A washer may be provided between the sleeve and underlying foundation.

The sleeve may comprise a lip extending around at least a portion of a perimeter of the sleeve. The sleeve lip may exceed the dimensions of the opening in the base plate.

The anchoring assembly may further comprise an insulator configured to insulate the sleeve from the base plate. The insulator may fit in the base plate opening.

The insulator may comprise an opening configured to receive the sleeve. The sleeve may extend below the insulator when installed.

The insulator may comprise a lip extending around at least a portion of a perimeter of the insulator. The insulator lip may exceed the dimensions of the opening in the base plate.

The sleeve lip may rest on the insulator lip when installed. The insulator lip may rest on the base plate top surface.

The sleeve passage may extend in a direction perpendicular to a longitudinal axis of the fastener when installed such that the lateral position of the sleeve and base plate relative to the underlying foundation may be adjusted.

A top surface of the sleeve may be substantially flat.

The base plate may have a substantially flat top surface in the region of the opening. For example, the base plate top surface may be without serrations in the region of the opening.

The fastener may be tightened with a torque of between 400 NM and 500 Nm. By contrast, with prior arrangements, fasteners may be tightened with a torque of approximately 150 Nm.

The base plate may be configured to extend beneath the rail. The anchoring assembly may comprise a further fastener and a further rigid sleeve. The base plate may comprise a further opening. The fastener may pass through the rigid sleeve and base plate opening on one side of the rail. The further fastener may pass through the further rigid sleeve and base plate further opening on the other side of the rail.

BRIEF DESCRIPTION OF THE DRAWINGS

Reference will now be made to the accompanying drawings in which.

DETAILED DESCRIPTION

Figure 1:
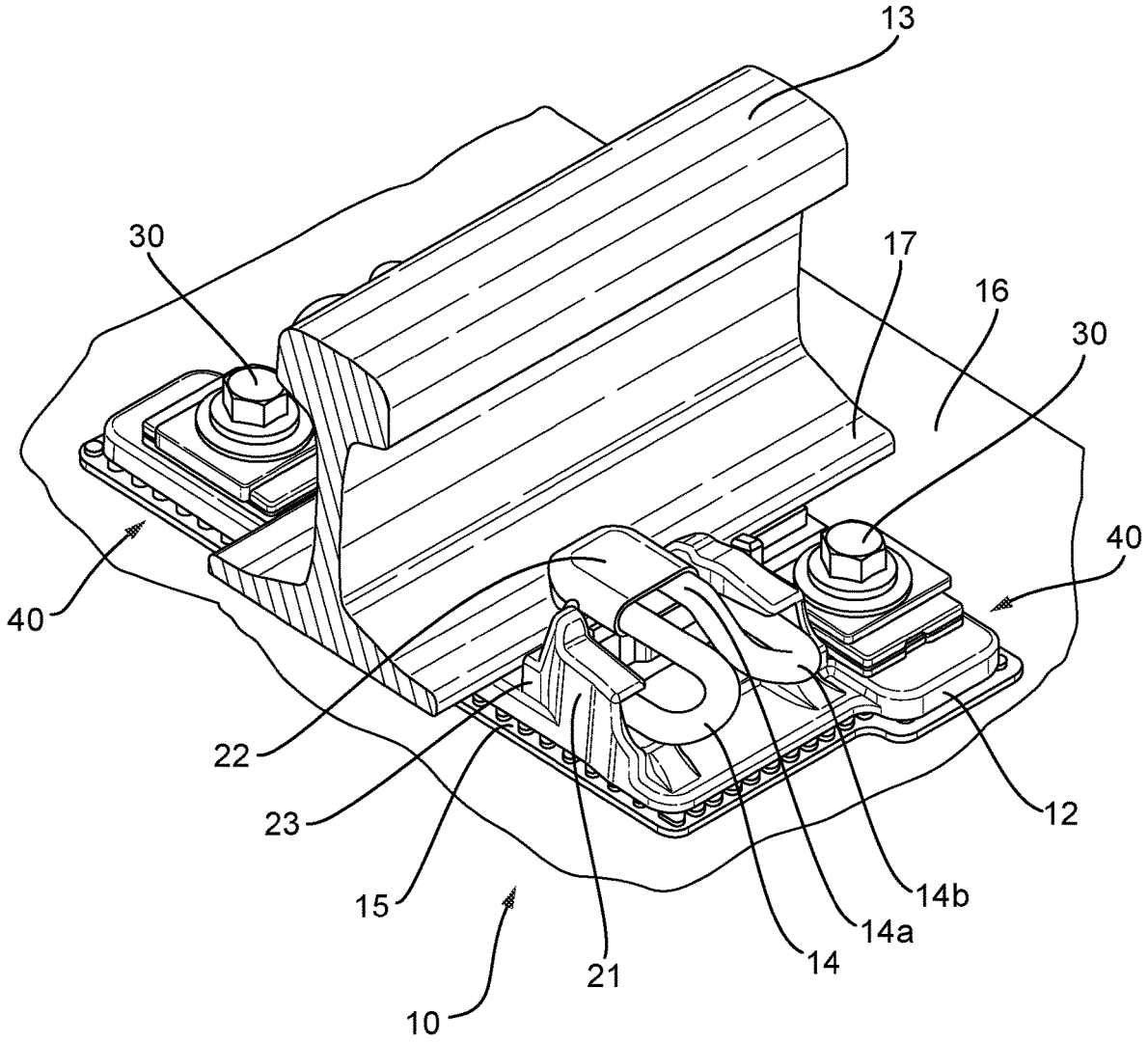
FIG. 1 is a perspective view showing a railway rail fastening assembly comprising an anchoring assembly according to an example of the present disclosure.

With reference to FIG. 1, a railway rail fastening assembly 10, according to an example of the present disclosure, comprises an anchoring device, such as a base plate 12. The base plate 12 may be configured to receive one or more railway rail fastening clips 14, which bear on a base or foot 17 of a rail 13. The base plate 12 extends beneath the rail 13 and is configured to receive the railway rail fastening clips 14 either side of the rail, although in alternative arrangements, respective anchoring devices may be provided on either side of the rail.

The base plate 12 is anchored to an underlying foundation 16, such as a railway sleeper or slab. An anchoring assembly 40 according to an example of the present disclosure connects the anchoring device, e.g. base plate 12, to the underlying foundation 16. The anchoring assembly 40 comprises a fastener 30, such as a stud, bolt or screw, which passes through an opening in the base plate 12. In the example shown, a pair of anchoring assemblies 40 is provided, one on each side of the rail 13. In the depicted arrangement, respective anchoring assemblies 40 are provided alongside corresponding clips 14 on each side of the rail. Furthermore, the clip 14 on one side of the rail 13 may face an anchoring assembly 40 on the other side of the rail.

A resilient rail pad 15 may be provided between the rail 13 and base plate 12. The pad 15 may comprise a plate of resilient material for providing cushioning between the rail foot 17 and the underlying foundation 16. Although not shown, a further resilient pad and a further plate may be provided between the base plate 12 and the underlying foundation 16, although either or both of these components may be omitted. The further plate may function as a spacing shim.

The clip 14 may be configured such that it can be deflected from a non-operative configuration to at least one operative configuration in which a toe portion 14*a* of the clip bears indirectly on the rail via an insulator 22. (In an alternative arrangement, the insulator may be omitted such that the clip bears directly on the rail.) A heel portion 14*b* of the clip may be received in a receiving portion 21 on the base plate. The clip 14 may be resilient and may be made from a rod of resilient material.

The clip 14 may be of the type that is inserted into engagement with the base plate 12 and rail 13 in a direction perpendicular to a longitudinal axis of the rail. However, other clip types are also envisaged, e.g. clips that are inserted in a direction substantially parallel to the longitudinal axis of the rail. Furthermore, although a particular base plate, which cooperates with a corresponding clip, is shown in FIG. 1, it is envisaged that the present invention may apply to any other type of base plates and/or clips.

The railway rail fastening assembly 10 may further comprise one or more electrically insulating wear pieces, such as the insulator 22 mentioned above. As described above, the insulator 22 may bear against the rail foot 17 in an installed configuration. The insulator 22 may electrically insulate the rail from the clip and/or limit wear between the rail and the clip. An insulator 23 may also be positioned between the receiving portion 21 and the rail foot 17 in an installed configuration and the insulator 23 may extend along the width of the receiving portion. The insulators 22, 23 and/or rail pad 15 may electrically insulate the rail from the base plate 12 and/or limit wear between the rail and the base plate.

Referring now to FIGS. 2 to 6, each of the anchoring assemblies 40 further comprise a rigid sleeve 50 defining a passage 52 through which the fastener 30 passes. The base plate 12 comprises an opening 18 and the sleeve 50 is configured to fit in and extend through the base plate opening 18. The sleeve 50 and fastener 30 may also pass through an opening in the resilient pad 15 (or the resilient pad 15 may not extend as far as the sleeve/fastener).

The fastener 30 may comprise a head 31 and a stem 32. A first end 32*a* of the stem is configured for placement in the underlying foundation 16. At least a portion of the stem 32 may be threaded and may engage a corresponding thread provided in the underlying foundation 16. A second end 32*b* of the stem is configured for engagement with the fastening assembly 10. The fastener head 31 is provided at the second end 32*b* of the stem 32. The fastener 30 may clamp the sleeve 50 between the underlying foundation 16 and the head 31 of the fastener.

Figure 3A:
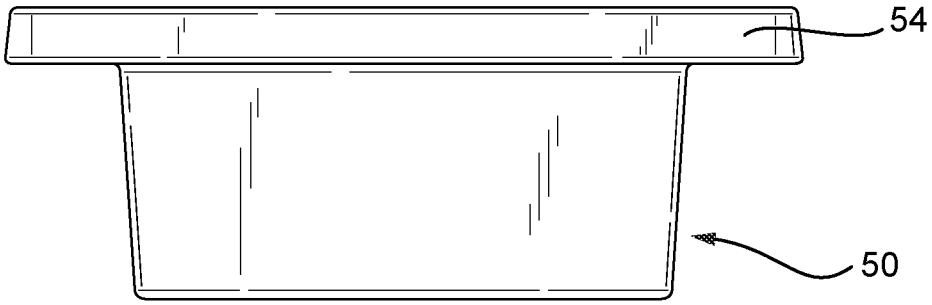
FIGS. 3*a* and 3*b* (collectively FIG. 3) are side and top views respectively of a sleeve of the anchoring assembly according to the example of the present disclosure.
Figure 3B:
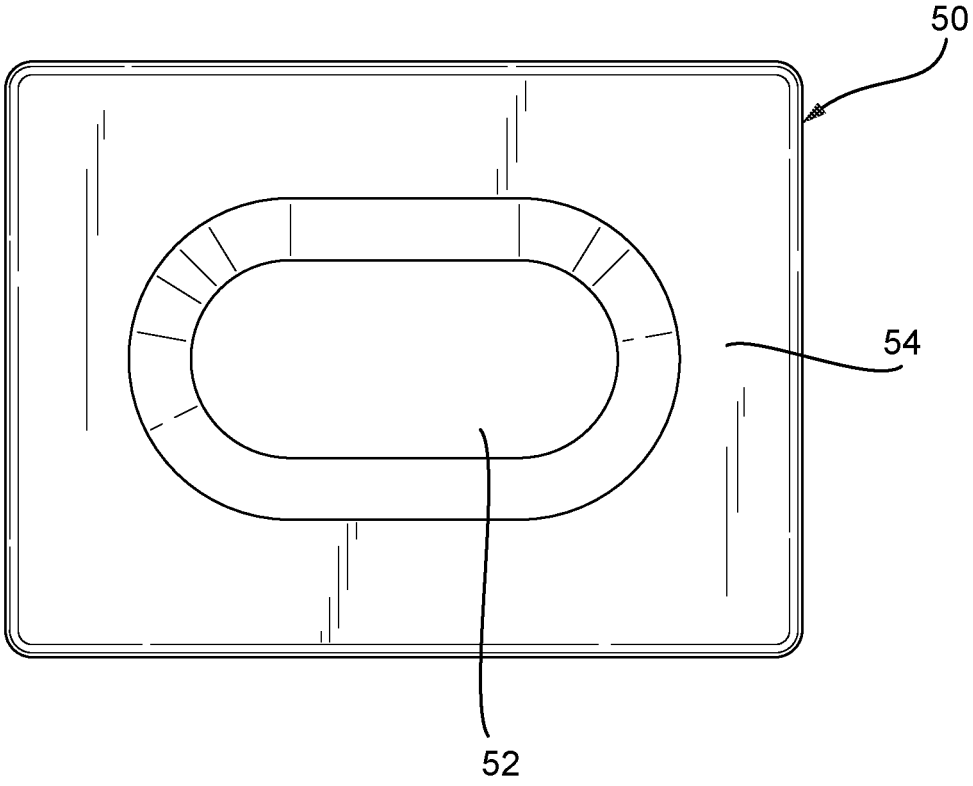

With particular reference to FIG. 3, the sleeve 50 may comprise a lip 54 extending around at least a portion of a perimeter of the sleeve 50. The sleeve lip 54 may exceed the dimensions of (e.g. overhang) the opening 18 in the base plate 12. The sleeve lip 54 may be provided at one end of the sleeve 50. The sleeve 50 may otherwise be substantially tubular with a wall surrounding the passage 52. The sleeve 50 may be made from a rigid material, e.g. such as a metal.

The sleeve passage 52 may extend in a direction perpendicular to a longitudinal axis of the fastener 30 when installed such that the lateral position of the sleeve 50 (and thus base plate 12) may be adjusted relative to the fastener 30 (and thus underlying foundation 16). The passage 52 may thus be elongate in the direction perpendicular to a longitudinal axis of the fastener. The passage 52 may be rectangular in cross-section and may have rounded ends.

Figure 4:
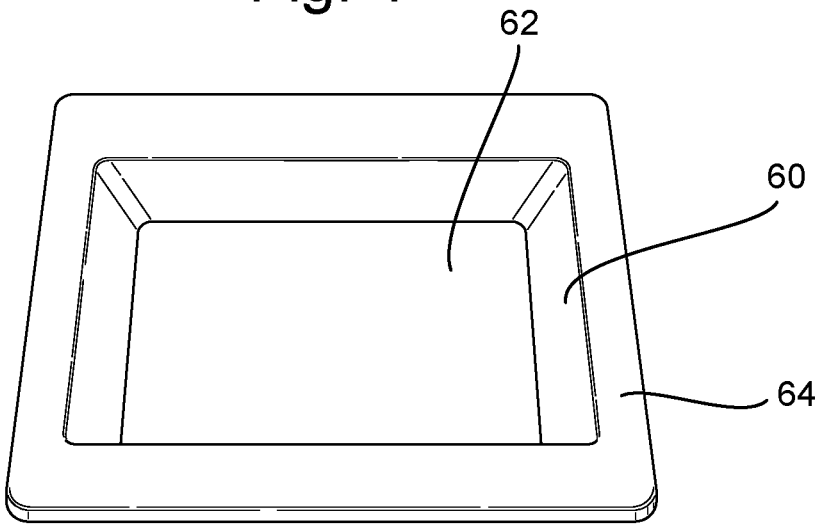
FIG. 4 is a top view of an insulator of the anchoring assembly according to the example of the present disclosure.
Figure 5:
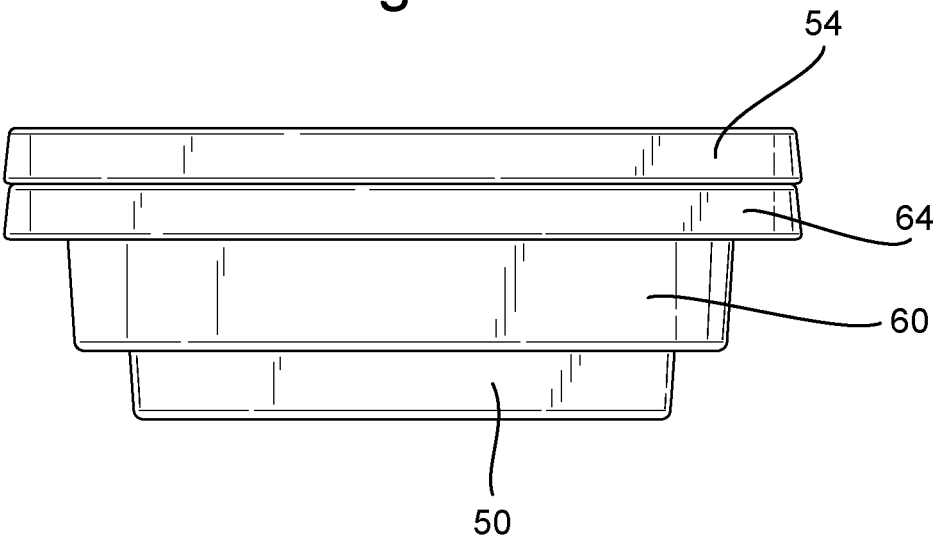
FIG. 5 is a side view of the sleeve and insulator of the anchoring assembly according to the example of the present disclosure.

Referring to FIGS. 4 and 5, the anchoring assembly 40 may further comprise an insulator 60 configured to insulate the sleeve 50 and fastener 30 from the base plate 12. The insulator 60 may fit in the base plate opening 18 and the insulator may in turn comprise an opening 62 configured to receive the sleeve 50. Accordingly, the insulator 60 may be provided between the sleeve 50 and base plate 12 and may electrically isolate one from the other. The insulator 60 may be made from a plastics material. The insulator opening 62 may extend in a direction perpendicular to a longitudinal axis of the fastener in order to accommodate the sleeve 50. The sleeve 50 and insulator 60 may together fit in the base plate opening 18 so that relative lateral movement may be prevented.

The insulator 60 may comprise a lip 64 extending around at least a portion of a perimeter of the insulator. The insulator lip 64 may exceed the dimensions of (e.g. overhang) the opening 18 in the base plate 12. The insulator lip 64 may be provided at one end of the insulator 60. The insulator lip 64 may rest on a top surface of the base plate 12. The sleeve lip 54 may in turn rest on the insulator lip 64 when installed.

Figure 6:
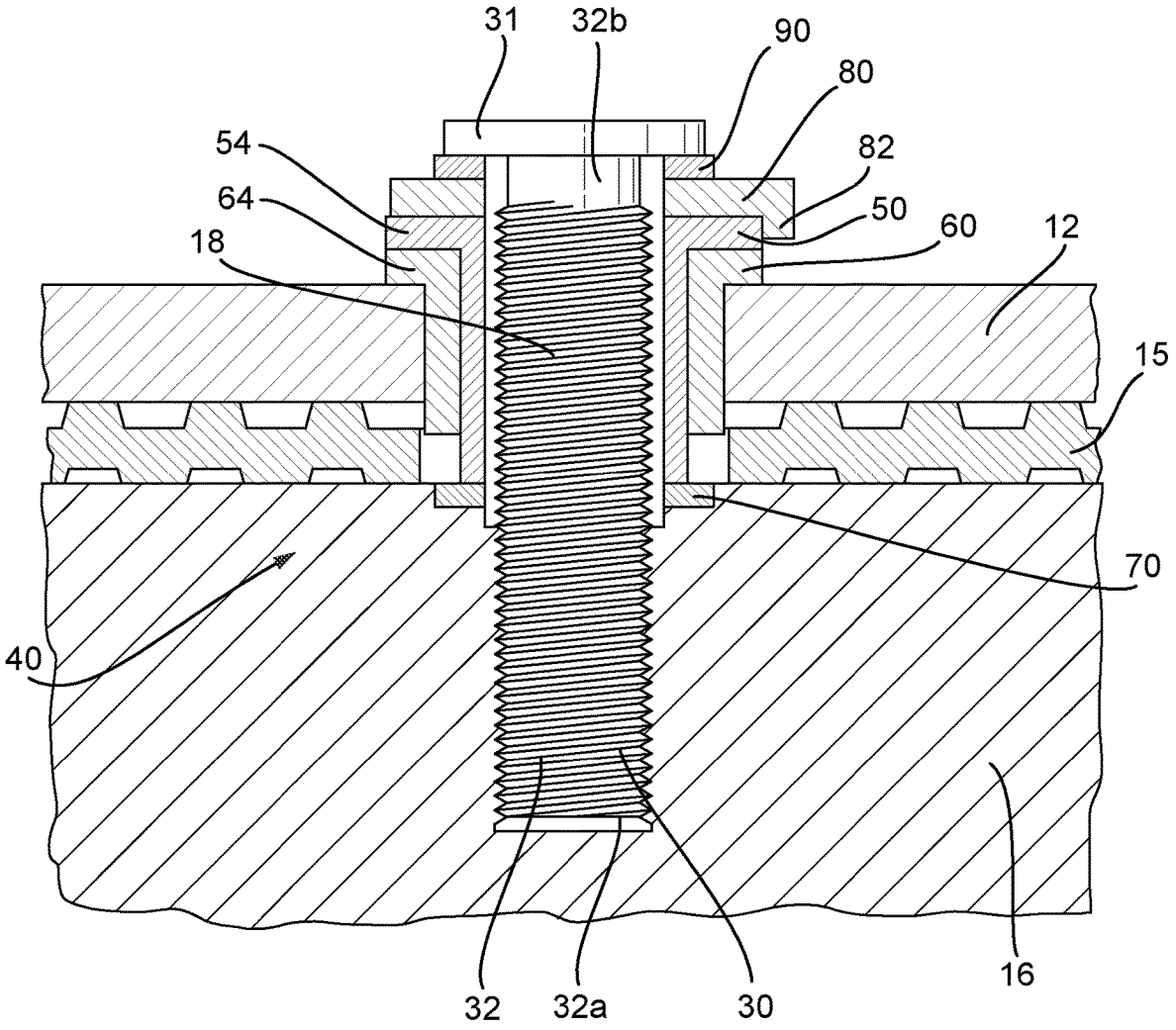
FIG. 6 is a schematic sectional view of the anchoring assembly according to the example of the present disclosure.

As is best depicted in FIG. 6, the insulator 60 may be sized so as extend below a bottom surface of the base plate 12 when installed. This may help to ensure that the base plate is isolated from the sleeve 50 and fastener 30. The sleeve 50 may also be sized so as to extend below the insulator 60 when installed.

Referring still to FIG. 6, the sleeve 50 may engage the underlying foundation 16 when installed. The sleeve 50 may directly engage, e.g. contact, the underlying foundation 16. Alternatively, as depicted, the sleeve 50 may indirectly engage the underlying foundation 16, e.g. via a washer 70 provided between the sleeve 50 and underlying foundation 16. The washer 70 may be rigid and may assist in distributing a load from the sleeve 50 to the underlying foundation 16. The washer 70 may exceed the dimensions of the sleeve 50 at their interface and in a direction perpendicular to the longitudinal axis of the fastener 30.

Figure 2:
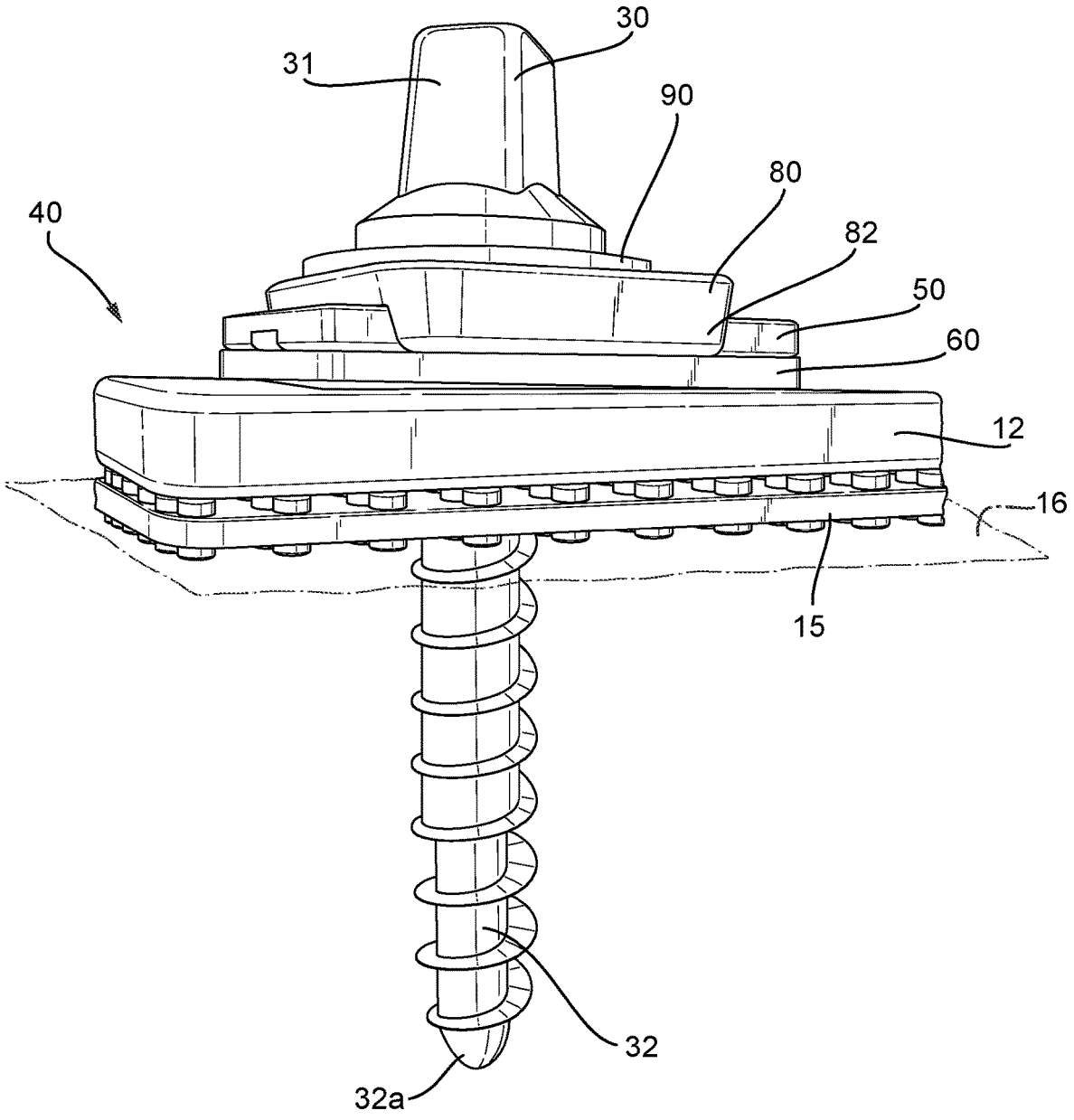
FIG. 2 is a side view of the anchoring assembly according to the example of the present disclosure.

As shown in FIGS. 2 and 6, the anchoring assembly 40 may further comprise a spreader plate 80 provided between the fastener head 31 and the sleeve 50. The spreader plate 80 may comprise an opening through which the fastener stem 32 may pass. The spreader plate opening may not be elongate, e.g. the spreader plate opening may be substantially circular in cross-section, although other shapes are also contemplated. The spreader plate 80 may provide a transition from the fastener head 32 to the elongate sleeve passage 52 and may assist in distributing the force from the fastener head 32. The spreader plate 80 may comprise a lip 82 along one edge. The spreader plate lip 82 may help locate the spreader plate relative to the sleeve 50 and may assist in resisting rotation of the spreader plate 80 as the fastener 30 is tightened.

The anchoring assembly 40 may further comprise a further washer 90 provided between the fastener head 31 and the sleeve 50. In particular, the further washer 90 may be provided between the fastener head 31 and the spreader plate 80.

As depicted in FIG. 6, when installed, the sleeve 50 extends a distance greater than a thickness of the base plate 12 such that a bottom end of the sleeve 50 extends past the bottom surface of the base plate 12. Furthermore, as mentioned above, one end (e.g. a bottom end) of the sleeve 50 (directly or indirectly) engages the underlying foundation when installed. By contrast, the other (e.g. top) end of the sleeve 50 is engaged by the fastener head 32 (directly or indirectly). Accordingly, the sleeve 50 is configured such that a compressive load applied by the fastener 30 is transmitted through the sleeve 50 to the underlying foundation 16.

The compressive load transmitted through the sleeve 50 may substantially bypass the base plate 12 and/or resilient pad 15. In other words, a compressive load transmitted through the sleeve 50 may be substantially greater than a compressive load that may be transmitted through the resilient pad 15. In fact, there may be no or little compressive load transmitted through the base plate 12 and resilient pad 15 and the base plate 12 may be free to move relative to the sleeve 50 (albeit constrained by the sleeve lip 54 and underlying foundation 16).

Transmitting the compressive force through the rigid sleeve 50 allows a larger force than if the compressive force were transmitted through the base plate 12 and resilient pad 15. For example, using the anchoring assembly 40 of the present disclosure may permit the fastener to be tightened with a torque of between 400 NM and 500 Nm. By contrast, with prior arrangements, the fasteners may be tightened with a torque of approximately 150 Nm. The larger torques applied with the present disclosure result in larger tension forces within the stem 31 of the fastener 30. The increase in tension within the stem 31 assists the fastener in resisting bending forces that act upon the fastener, e.g. due to lateral loads applied to the assembly 10. The fastener 30 may therefore be less likely to fail (or a fastener with a larger stem may not be required). Furthermore, the greater resistance to bending forces may increase the vertical adjustability of the base plate 12.

A top surface of the sleeve 50 may be substantially flat, e.g. with a substantially smooth surface. The base plate 12 may therefore be continuously adjustable in a lateral direction relative to the fastener 30, for example as the spreader plate 80 may slide to any lateral position on the sleeve 50. When the fastener 30 is tightened, the lateral position of the base plate 12 may be secured by the lateral constraint of the sleeve 50 (and insulator) in the base plate opening 18. This contrasts with prior art arrangements in which serrations on the base plate around an opening may provide lateral constraint. The base plate 12 of the present disclosure may instead have a substantially flat top surface in the region of the base plate opening 18, e.g. without serrations in the region of the opening. This simplifies the construction of the base plate and increases the lateral adjustability of the assembly 10 according to the present disclosure.

What is claimed is:

1. An anchoring assembly for fastening a railway rail to an underlying foundation; the anchoring assembly comprising:

a base plate configured to receive the rail;

a fastener configured to fasten the base plate to the underlying foundation; and a rigid sleeve defining a passage through which a stem of the fastener passes, wherein the base plate comprises an opening and the sleeve is configured to extend through the base plate opening, wherein the sleeve extends a distance greater than a thickness of the base plate such that the sleeve extends from a top surface of the base plate and beyond a bottom surface of the base plate when installed, wherein the sleeve is configured such that a compressive load applied by the fastener when installed is transmitted through the sleeve to the underlying foundation, and wherein the sleeve passage extends in a direction perpendicular to a longitudinal axis of the fastener when installed such that the lateral position of the sleeve and base plate relative to the underlying foundation is adjustable.

2. The anchoring assembly of claim 1, wherein the anchoring assembly further comprises a resilient pad provided between the base plate and the underlying foundation.

3. The anchoring assembly of claim 2, wherein the compressive load transmitted through the sleeve substantially bypasses the resilient pad.

4. The anchoring assembly of claim 2, wherein the sleeve passes through an opening in the resilient pad.

5. The anchoring assembly of claim 1, wherein the fastener comprises a head at one end of the stem.

6. The anchoring assembly of claim 5, wherein the fastener clamps the sleeve between the underlying foundation and the head of the fastener.

7. The anchoring assembly of claim 5, wherein the anchoring assembly further comprises a spreader plate provided between the fastener head and the sleeve.

8. The anchoring assembly of claim 1, wherein the sleeve comprises a lip extending around at least a portion of a perimeter of the sleeve, wherein the sleeve lip exceeds the dimensions of the opening in the base plate.

9. The anchoring assembly of claim 1, wherein the anchoring assembly further comprises an insulator configured to insulate the sleeve from the base plate.

10. The anchoring assembly of claim 9, wherein the insulator comprises an opening configured to receive the sleeve.

11. The anchoring assembly of claim 9, wherein the sleeve extends below the insulator when installed.

12. The anchoring assembly of claim 9, wherein the insulator comprises a lip extending around at least a portion of a perimeter of the insulator, wherein the insulator lip exceeds the dimensions of the opening in the base plate.

13. The anchoring assembly of claim 12, wherein the sleeve comprises a lip extending around at least a portion of a perimeter of the sleeve, wherein the sleeve lip exceeds the dimensions of the opening in the base plate, and wherein the sleeve lip rests on the insulator lip when installed.

14. The anchoring assembly of claim 1, wherein a top surface of the sleeve is substantially flat.

15. The anchoring assembly of claim 1, wherein the base plate has a substantially flat top surface in the region of the opening.

16. The anchoring assembly of claim 1, wherein the fastener is tightened with a torque of between 400 NM and 500 Nm.

17. The anchoring assembly of claim 1, wherein the base plate is configured to extend beneath the rail.

18. The anchoring assembly of claim 17, wherein the anchoring assembly comprises a further fastener and a further rigid sleeve and the base plate comprises a further opening, and wherein the fastener passes through the rigid sleeve and base plate opening on one side of the rail and the further fastener passes through the further rigid sleeve and base plate further opening on the other side of the rail.

* * * * *